US005108671A

United States Patent [19]

Chapdelaine

[11] Patent Number: 5,108,671

[45] Date of Patent: Apr. 28, 1992

[54] CONCRETE FORMWORK AND METHOD FOR FORMING A DRAFT TUBE

[75] Inventor: Louis Chapdelaine, Montreal, Canada

[73] Assignee: Kiewit Construction Group Inc., Omaha, Nebr.

[21] Appl. No.: 741,335

[22] Filed: Aug. 7, 1991

[51] Int. Cl.[5] ..... B28B 1/16; B28B 7/36; E04B 1/16

[52] U.S. Cl. ..... 264/32; 52/584; 52/601; 249/10; 249/11; 249/114.1; 249/115; 249/134; 249/135; 249/177; 249/184; 249/189; 264/31; 264/33; 264/35; 264/40.1; 264/130; 264/131; 264/133; 264/225; 264/227; 264/261; 264/263; 264/273; 264/274; 264/277; 264/279; 264/279.1; 264/297.1; 264/313; 264/316; 264/318; 264/334; 264/337; 264/338; 405/135; 405/149; 405/152; 425/59; 425/182

[58] Field of Search ..... 264/40.1, 313, 318, 264/337, 338, 334, 297.1, 219, 220, 225-227, 333, 316, 31-35, 130, 131, 133, 261, 263, 273, 274, 277, 279, 279.1; 405/149, 150.2, 134, 135, 151, 152, 153; 425/59, 182, DIG. 238; 249/10, 11, 184, 114.1, 115, 134, 135, 177, 189, 139; 52/581, 584, 601, 741

[56] References Cited

U.S. PATENT DOCUMENTS

| | | | |
|---|---|---|---|
| 974,960 | 11/1910 | Grohs | 249/184 |
| 1,696,694 | 12/1928 | Senesac | 249/184 X |
| 1,865,500 | 7/1932 | Bemis | 264/34 |
| 2,447,620 | 8/1948 | Singleton et al. | 249/114.1 X |
| 2,780,150 | 2/1957 | Yeoman | 264/261 |
| 2,881,501 | 4/1959 | Raney | 249/184 X |
| 3,179,725 | 4/1965 | Schultz et al. | 264/219 X |
| 3,682,434 | 8/1972 | Boenig | 249/115 X |
| 3,729,165 | 4/1973 | Trimble | 249/184 X |
| 4,167,549 | 9/1979 | Creskoff | 264/338 X |
| 4,250,675 | 2/1981 | Medder | 264/34 X |
| 4,637,585 | 1/1987 | Picollo | 249/10 |
| 4,826,639 | 5/1989 | Vidal et al. | 264/333 X |
| 4,834,929 | 5/1989 | Dehoff et al. | 249/115 X |
| 4,844,403 | 7/1989 | Castle | 249/10 |
| 4,863,663 | 9/1989 | Nico, Jr. et al. | 264/226 X |
| 4,946,552 | 8/1990 | Onnie | 264/219 X |

*Primary Examiner*—Karen Aftergut

*Attorney, Agent, or Firm*—Sterne, Kessler, Goldstein & Fox

[57] ABSTRACT

A formwork for a draft tube which includes ganged precast forms, each precast form corresponding to a curved segment of the draft tube. The precast forms are molded with continuous side plates extending thereabout and anchored in the precast concrete form and projecting beyond the surface opposite to the contact surface to provide a flange. A fastening means for attaching adjacent forms with a space therebetween to allow for stripping. A method includes determining the outline of the inner surface of the draft tube and dividing it into segments and preparing molds to make precast forms corresponding to each segment. The precast forms are assembled and shored to provide the draft tube ganged formwork, and concrete is poured about the draft tube formwork and is cured. The precast forms are stripped from the set concrete structure and reused in another draft tube formwork.

8 Claims, 3 Drawing Sheets

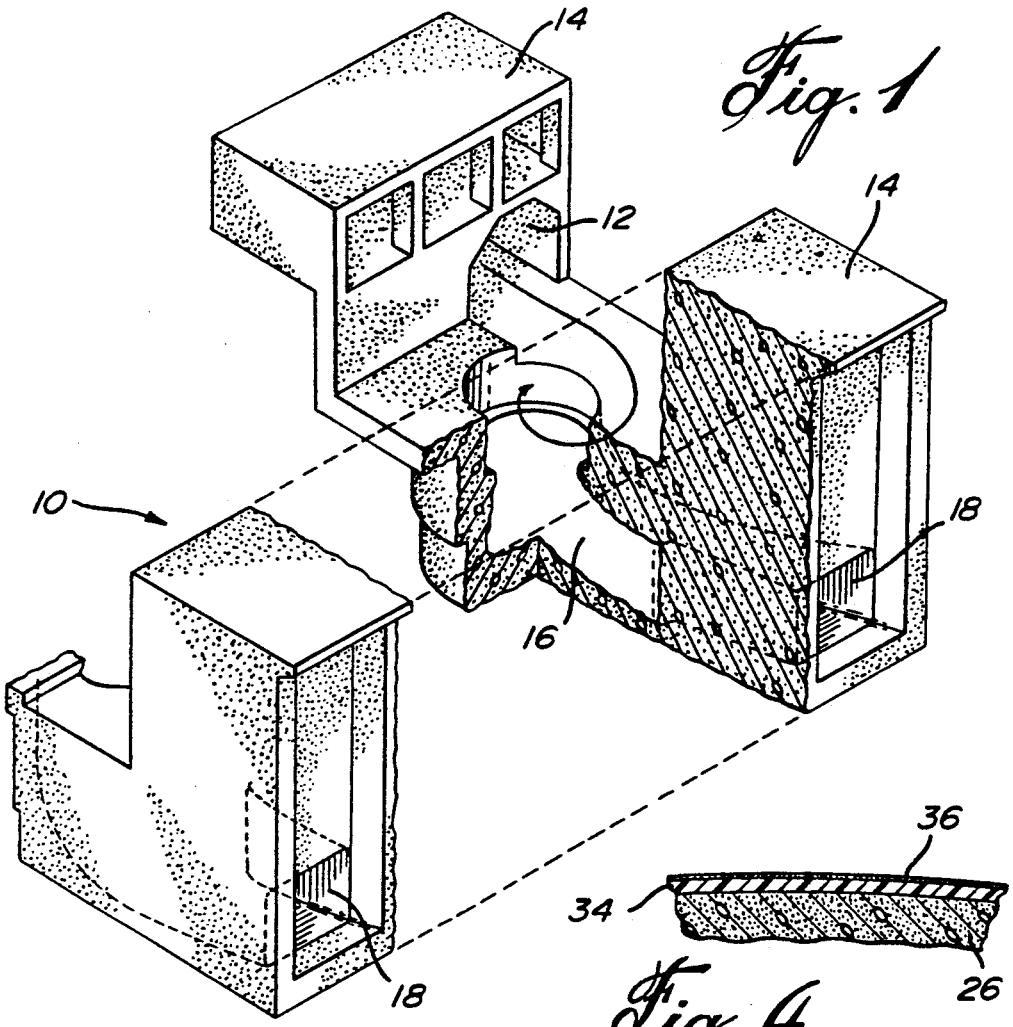
Fig. 1
Fig. 4
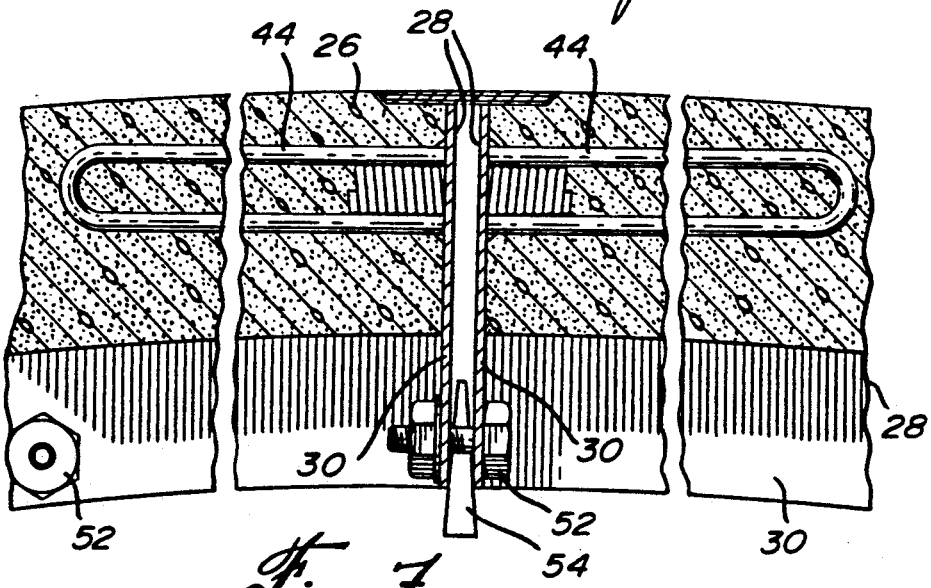
Fig. 7

CONCRETE FORMWORK AND METHOD FOR FORMING A DRAFT TUBE

BACKGROUND OF THE INVENTION

1. Field of the Invention

The present invention relates to concrete formwork, and more particularly, to prefabricated formwork for the in situ formation of complex curved structures.

2. Description of the Prior Art

It is common practice to build prefabricated wood formwork for complex curved structures, such as draft tubes utilized in hydroelectric power houses. A draft tube conducts the used water immediately downstream of a turbine which allows the water exhausting from the turbine to be diffused.

The draft tube is normally defined in the concrete power house foundations under each turbine. The draft tube defines a circular opening at the base or outlet of the turbine which gradually changes to an ellipse and then to a wide flattened mouth of increased sectional area while the longitudinal axis of the tube changes 90° or less from the vertical to a somewhat horizontal plane. Thus, in order to pour the concrete foundation while defining the draft tube, a giant plug in the form of the tube must be provided in order to allow the concrete to be poured around the plug. As can be seen, the draft tube cannot be precast and transported to the site but must be formed in situ.

According to the handbook "Formwork for Concrete", M. K. Hurd, Fifth Edition, published in 1989 by Committee 347 of the American Concrete Institute, the "plug" or formwork would be made from wood. Also, as noted in this reference, the wooden "plug" can be prebuilt in segments and assembled on site. This allows for easier manufacture of the plug and for easier stripping, and the forms can be reused as a formwork plug on other sites.

However, each wood form is a complicated structure requiring highly skilled artisans. Each form has a complexly curved, three-dimensional contact or mold surface. The mold surface of the form must be smooth in order to provide a fair-faced surface which is free of any anomalies which might cause turbulence in the water flow resulting in cavitation in the tube surface.

The fabrication of such wood forms is also time consuming, requiring anywhere from six to eight weeks for each one to be made. In order to reuse the forms, considerable repair must be made to the wood form after it has been stripped. In view of the inherent flexibility of the wood form, it must be carefully and heavily shored to ensure that its predetermined shape is faithfully maintained.

SUMMARY OF THE INVENTION

It is an aim of the present invention to provide an improved formwork which is more quickly produced, requires less skilled labor, and is, therefore, more economical.

It is a further aim of the present invention to provide a formwork which can be reused with nominal repair after stripping.

It is a still further aim of the present invention to provide forms which are rigid and thus maintain their predetermined shape in any proper shoring conditions and which require lighter shoring than for equivalent wood forms.

It is still a further aim to provide a method of making the improved formwork in an efficient and economical manner.

A construction in accordance with the present invention comprises a ganged formwork kit for providing a removable plug in the formation of a concrete structure to provide an irregular tube. The formwork kit includes a plurality of precast concrete forms each having a smooth contact surface on one side thereof corresponding to a segment of the inner surface of the tube to be formed. Each precast concrete form has a metal plate extending continuously about the periphery of the form and extending in planes at right angles to the form beyond the other side of the form to provide a flange. Fastening means are provided for attaching corresponding flanges of adjacent forms together when the ganged formwork is assembled. Discrete openings are provided in each form, and tie rods are accommodated in the discrete openings to engage and support the form to supporting adjacent structure.

A method in accordance with the present invention comprises the steps of determining the inner surface outline of an irregular tube to be formed in a concrete structure and dividing the inner surface outline into two-dimensional segments. Molds are prepared to make precast forms corresponding to each segment. The precast forms are assembled and shored to provide the irregular tube ganged formwork, with each form slightly spaced from an adjacent form. Concrete is poured about the irregular tube formwork, the concrete is cured, and the precast forms are stripped from the set concrete structure. The precast forms can thus be reused in another irregular tube formwork.

BRIEF DESCRIPTION OF THE DRAWINGS

Having thus generally described the nature of the invention, reference will now be made to the accompanying drawings, showing by way of illustration, a preferred embodiment thereof, and in which:

FIG. 1 is a fragmentary perspective exploded view of a foundation for a power house;

FIG. 4 is an enlarged fragmentary cross-sectional view of a detail shown in FIG. 3;

FIG. 7, which is on the same sheet as FIG. 1, is a fragmentary vertical cross-section, taken along line 7—7 of FIG. 2.

DESCRIPTION OF THE PREFERRED EMBODIMENTS

Figure 2:
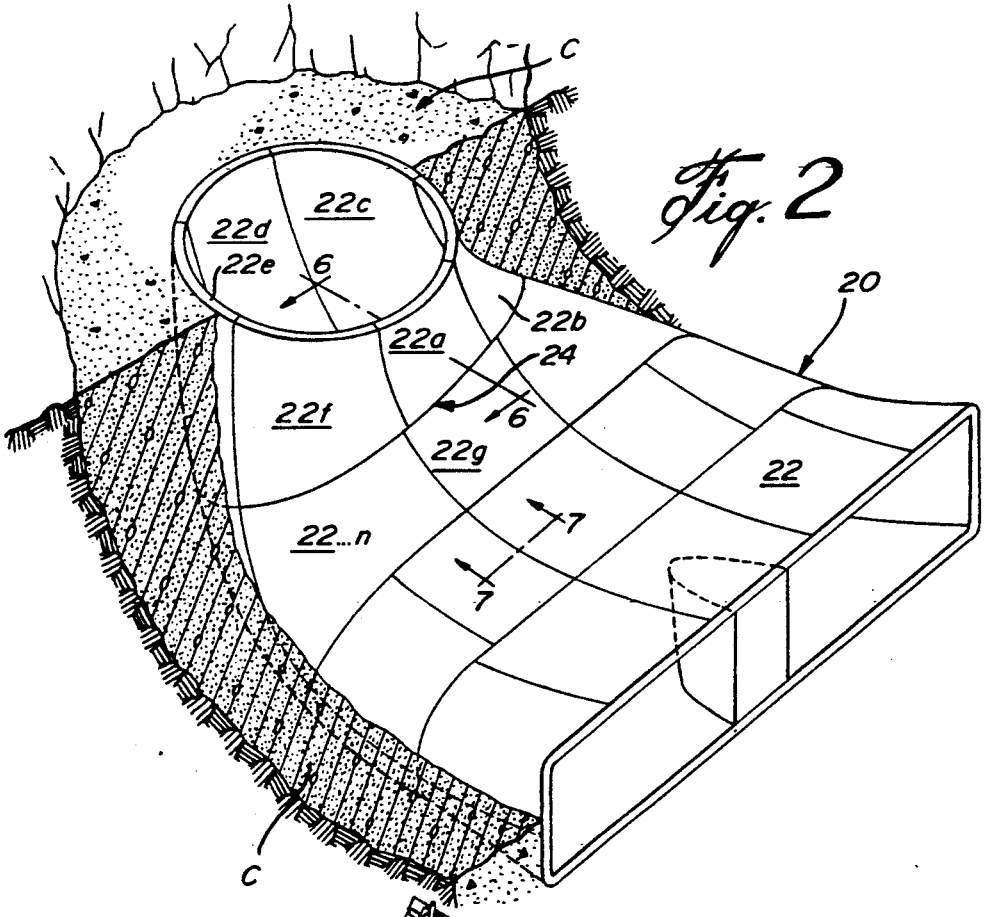
FIG. 2 is a fragmentary perspective view of a ganged formwork in accordance with the present invention for forming a draft tube.

Referring to the drawings, and in particular to FIG. 1, there is shown a portion of a concrete foundation base 10 for a power house (not shown) and in particular that portion on which a turbine would sit. The penstock 12 is illustrated in relation to where the turbine would sit below the machine hall floor 14.

A draft tube 16 and tail race 18 are partially shown in FIG. 1. It is the formation of the draft tube which is the subject of the present invention.

FIG. 2 shows a ganged formwork 20 made up of forms 22. Each individual form 22 is assembled together to form the overall inner surface outline of the draft tube 16. (In FIG. 2, the shoring has been eliminated in order to best see the ganged forms 22.) For a better understanding of the assembled draft tube formwork, certain specific forms 22*a*, 22*b*, 22*f*, 22*g*, of the soffit, have been illustrated.

Figure 3:
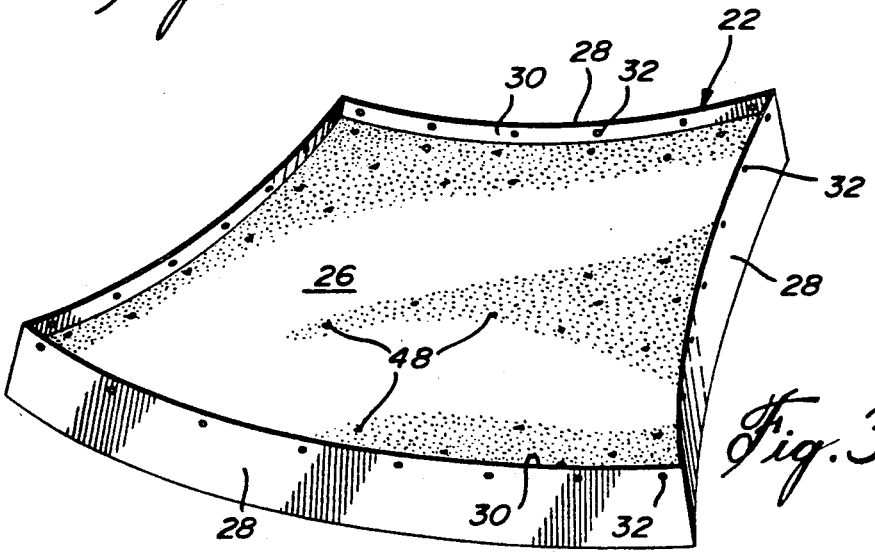
FIG. 3 is a perspective view of a detail of a form shown in FIG. 2.

Each form 22*a*, 22*b* . . . , 22*n* is the same as the form 22 illustrated in FIG. 3. Only the curved shape of the individual forms 22 will change. Each form 22 includes a reinforced precast concrete panel 26 provided with openings 48 to pass tie rods as will be described.

The periphery of the precast concrete panel 26 is provided with steel plates 28, each extending the full length of the edge of the panel 26 and at right angles thereto.

The steel plates 28 are preformed by cutting the plates according to the actual curved shape of the edge of panel 26. The width of each panel 28 is such that it extends beyond the thickness of the panel 26 so that it forms a flange on the interior of the panel 26 as illustrated in FIGS. 3 and 7.

The plates 28 are fixed to the precast panel 26 by means of anchors 44 shown in FIG. 7. These anchors 44 are welded to the plates 28 and are set within the reinforced concrete when the concrete panel 26 is being molded. The flange 30 formed by the plates 28 is provided with openings 32 to allow for fasteners as will be described later.

Figure 5:
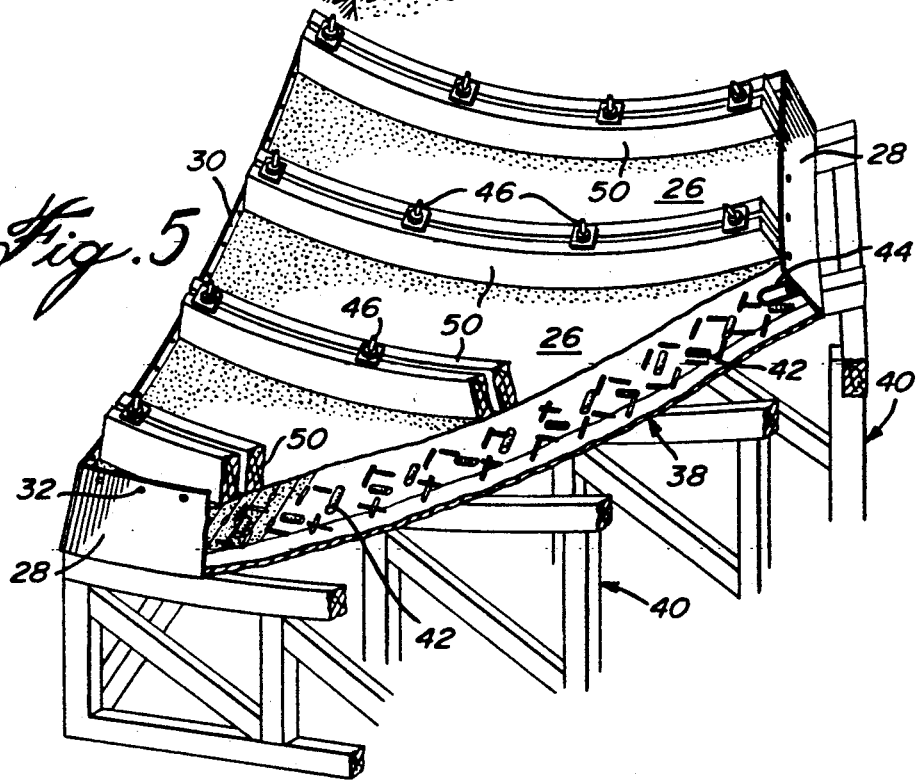
FIG. 5 is a fragmentary perspective view of a mold for making a form in accordance with FIG. 3.

Each of the precast forms 22 is fabricated by a mold as shown in FIG. 5. Each mold includes a mold panel 38 preferably made of plywood. The mold panel 38 is mounted on a crib 40 and is formed to reproduce the curved surface of the draft tube segment to be formed. Reinforcing rods are then laid in a grid on the molding panel 38, and molding strips 50 are set and held by means of tie rods 46 which pass through the panel 38.

The molding strips 50 are set at the proper thickness to which the precast concrete panel is to be molded.

The plates 28 are then mounted around the panel 38 with the anchor elements 44 extending within the reinforcing rod grid and is temporarily wired to the grid. Concrete is then poured into the mold up to the level of the strips 50, and the concrete is allowed to cure.

Once the concrete has cured, the tie rods 46 are removed, and the molding ribs 50 are stripped from the inner surface of the concrete panel 26. The form 22 is then stripped from the molding panel 38 and inverted. The contact surface of the form 22 is thus exposed, and a treatment of the contact surface is then provided.

This treatment can include the application of a thin coating 34 of a fine cement such as SILKATOP 123 (trade-mark). This cement coating 34 can be polished, and it is then cured. Once the polished coating 34 has been cured, an epoxy paint as a release agent can be applied as at 36 in FIG. 4.

As noted previously, it is important that the inner surface of the draft tube 16 be as smooth as possible to avoid any anomalies which might cause cavitation when water rushes through the draft tube 16. Thus, it is necessary that the contact surface of form 22 be as smooth as possible.

Figure 6:
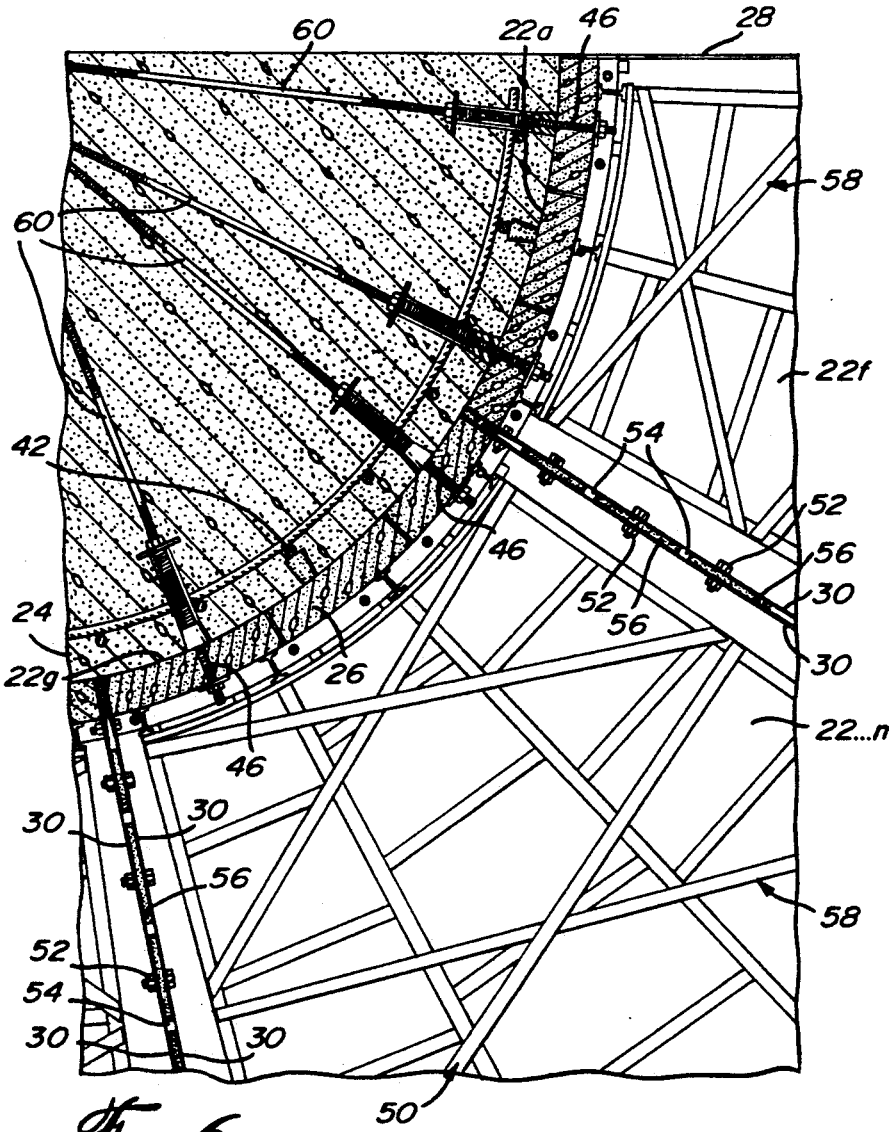
FIG. 6 is a fragmentary vertical cross-section of the formwork in position, taken somewhat along the line 6—6 in FIG. 2.

All of the forms 22 to make up the draft tube ganged formwork 20 would be fabricated at about the same time. The profile or outline of the draft tube inner surface is divided into segments which are as flat as reasonably possible to allow proper molding. In some cases, several forms 22 can be molded in side-by-side molds mounted on a common crib 40. When the forms 22 have been fabricated, they are transported to the site and assembled as shown in FIGS. 2 and 6.

When assembling the ganged formwork 20, each of the forms 22 is mounted on suitable shoring 58 and is attached to an adjacent form 22 by a tie bolt and nut 52 as shown in FIG. 7. A space is maintained between corresponding side plates 28 by means of wedges 54 as shown in FIGS. 6 and 7. Prior to pouring the concrete, a stuffing such as a closed cellular flexible plastic mat can be inserted in the space between adjacent plates 30. The joints between the forms 22 are thus sealed and may be patched by cement and polished to match the adjacent surface. It is necessary to provide this spacing at the joint in order to allow the forms to be stripped properly.

Tie bolts 46 are passed through the openings 48 in each form 22 and by means of connecting devices are attached to tie rods 60 to support the form. The tie rod 60 can be connected to the adjacent rock bed or to other support structure. All of the formwork 20 is supported by shoring 58 and/or tie rods 60 depending on the location of the forms 22.

Reinforcing rods can be located around the formwork 20, and concrete C is then poured in the space surrounding the formwork 20 to produce part of the power house foundation. Once the concrete C has been cured, the formwork 20 is removed by first removing the shoring 58 located inside the formwork 20 and then by removing the forms 22. For instance, form 22*a* may be a key form, and once that is removed, the remaining forms 22*b*, 22*c*, 22*d*, etc., . . . 22*n*, can be stripped as in a giant puzzle.

Each of the forms 22 is then cleaned and readied for the following installation. It is considered that at the most a polished surface coating 34 and epoxy paint 36 may have to be reapplied to the contact surface but that the form 22 would be intact and can be reused.

It is contemplated to leave the ganged formwork 20 within the draft tube. In order to do so, the inner surface of the forms would have to be prepared to a fair surface condition to the edge of the flanges. In other words, the inner surface of the ganged formwork would have to be left in a fair surface condition as is presently provided when the forms are stripped from the poured concrete. Of course, the shoring or curbing 58 would have to be removed from the draft tube. The forms in this case could not be reused.

I claim:

1. A ganged formwork kit for providing a removable plug during formation of a concrete structure by which an irregular tube is formed in the concrete structure, the ganged formwork kit including a plurality of precast concrete forms shaped to be adjacently connected together to form the removable plug and thereby define an inner surface of the irregular tube to be formed in the concrete structure, each form having a smooth contact surface on a first side thereof corresponding to a segment of the inner surface of the tube to be formed, each precast concrete form having a metal plate extending continuously about a periphery of the form and extending at right angles beyond a second side of the form to provide a flange, each precast concrete form having fastening means provided for attaching corresponding flanges of adjacent forms together when the ganged formwork kit is assembled, and each form being provided with discrete openings to accommodate tie rods adapted to attach the form to adjacent supporting structure for the casting of the tube about the removable plug during the formation of the concrete structure.

2. A formwork kit as defined in claim 1, wherein the irregular tube to be formed is a draft tube.

3. A formwork kit as defined in claim 1, wherein each form includes a polished contact surface provided by a coating of high-grade cement and a coating of release agent of epoxy paint.

4. A formwork kit as defined in claim 1, wherein a spacing sufficient to strip each form is provided between each adjacent form.

5. A method for providing an irregular tube in a concrete structure being formed, including the steps of determining an outline of an inner surface of the irregular tube, dividing the outline into two-dimensional curved segments, preparing molds to make precast concrete forms corresponding to each segment, making precast concrete forms corresponding to each segment in the prepared molds, each form having a smooth contact surface on a first side thereof and having a metal plate extending continuously about a periphery of the form and extending at right angles beyond a second side of the form to provide a flange thereon, adjacently assembling the precast concrete forms and shoring them to provide a formwork for the irregular tube to be formed with each form being slightly spaced from an adjacent form, pouring concrete about the irregular tube formwork against the smooth contact surface of each form, curing the concrete, and stripping the precast forms from the cured concrete structure and reusing the precast forms in another irregular tube formwork to form another irregular tube.

6. A method as defined in claim 5, wherein the irregular tube is in the form of a draft tube.

7. A method as defined in claim 5, wherein each precast form is prepared by making a mold corresponding to a respective curved segment and setting the mold to approximate horizontal, preparing a reinforcing rod grid in the mold and mounting metal side plates to complete the mold, the metal side plates having anchors which are attached to the reinforcing grid, pouring the concrete into the mold whereby the anchors of the metal side plates are set in the precast concrete form with a portion of the metal side plates projecting beyond the second side of the form opposite the first side having the smooth contact surface so that the flange is formed extending from the second side of the form.

8. A method as defined in claim 7, wherein the forms are assembled into a ganged formwork, and the peripheral flanges of the adjacent forms are fastened to each other with a space therebetween, and stuffing is provided in the space to seal the ganged formwork from the poured concrete.

* * * * *